US009110430B2

(12) United States Patent
Kase

(10) Patent No.: US 9,110,430 B2
(45) Date of Patent: Aug. 18, 2015

(54) CLEANING DEVICE, PROCESS CARTRIDGE AND IMAGE FORMING APPARATUS

(71) Applicant: CANON KABUSHIKI KAISHA, Tokyo (JP)

(72) Inventor: Takashi Kase, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 17 days.

(21) Appl. No.: 13/765,982

(22) Filed: Feb. 13, 2013

(65) Prior Publication Data

US 2013/0223905 A1 Aug. 29, 2013

(30) Foreign Application Priority Data

Feb. 23, 2012 (JP) ..... 2012-038054

(51) Int. Cl.
*G03G 21/00* (2006.01)

(52) U.S. Cl.
CPC ..... *G03G 21/0011* (2013.01); *G03G 21/0029* (2013.01)

(58) Field of Classification Search
CPC ..... G03G 21/0011; G03G 21/0029
USPC ..... 399/351
See application file for complete search history.

(56) References Cited

U.S. PATENT DOCUMENTS 3,848,993 A * 11/1974 Hasiotis ..... 399/351
5,517,294 A * 5/1996 Ogiri et al. ..... 399/351
6,223,014 B1 * 4/2001 Niwano et al. ..... 399/284
6,298,217 B1 10/2001 Murayama et al.
8,275,279 B2 9/2012 Naito et al.
2001/0005458 A1 * 6/2001 Yamanaka et al. ..... 399/43
2013/0017007 A1 1/2013 Naito et al.
2014/0153989 A1 * 6/2014 Shindo et al. ..... 399/351
2014/0153990 A1 * 6/2014 Oka et al. ..... 399/351

(Continued)

FOREIGN PATENT DOCUMENTS

CN 1139228 A 1/1997
CN 1182900 A 5/1998
CN 1304061 A 7/2001
JP 2002-341721 A 11/2002
JP 2011242732 A * 12/2011

OTHER PUBLICATIONS

English translation of JPA_2011242732.*

(Continued)

*Primary Examiner* — Billy Lactaoen
*Assistant Examiner* — Arlene Heredia Ocasio
(74) *Attorney, Agent, or Firm* — Fitzpatrick, Cella, Harper & Scinto

(57) ABSTRACT

A cleaning device for use with an image forming apparatus includes: a frame; and a cleaning member for removing a developer from an image bearing member (drum). The cleaning member includes: a blade portion contacted to the drum; and a flexible supporting member, the supporting member including one end portion where the blade portion is provided, another end portion including a portion-to-be-fixed, and a bent portion between the one end portion and the another end portion and a contact portion. When a distance between the portion-to-be-fixed and the drum in a longitudinal central side of the portion-to-be-fixed is D1, and a distance between the portion-to-be-fixed and the image bearing member in each of longitudinal end sides of the portion-to-be-fixed is D2, the distances D1 and D2 satisfy: D1≤D2.

27 Claims, 5 Drawing Sheets

(56) References Cited

U.S. PATENT DOCUMENTS

2014/0241772 A1* 8/2014 Watanabe et al. ..... 399/351
2014/0241773 A1* 8/2014 Mochizuki ..... 399/351

OTHER PUBLICATIONS

Office Action dated Feb. 3, 2015, in Chinese Application No. 201310056252.1.

* cited by examiner

CLEANING DEVICE, PROCESS CARTRIDGE AND IMAGE FORMING APPARATUS

FIELD OF THE INVENTION AND RELATED ART

The present invention relates to an electrophotographic image forming apparatus such as a copying machine, a laser beam printer or a facsimile machine, and relates to a cleaning device or use with the image forming apparatus, and a process cartridge.

In the electrophotographic image forming apparatus, a cleaning blade type as a cleaning means for removing, in order to repetitively use the image bearing member, the developer remaining on the image bearing member after transferring a developer image from the image bearing member onto a recording material (medium) has been known.

The cleaning type is a method in which a blade having elasticity is contacted to the surface of the image bearing member at a predetermined pressure to remove the developer from the surface of the image bearing member.

In Japanese Laid-Open Patent Application (JP-A) 2002-341721, the cleaning member has a structure in which a blade is mounted by molding at an end of a metal plate as a supporting member. Further, the metal plate is secured to a frame by a screw or the like to fix the cleaning member, so that the cleaning member is contacted to the surface of the image bearing member at the predetermined pressure.

However, the image forming apparatus such as the printer tends to be downsized, increased in speed and improved in image quality with popularization thereof. When the image forming apparatus is downsized, a size of the image bearing member becomes small. Further, by the speed-up, the image bearing member is quickly rotated. That is, the blade contacted to the image bearing member surface repetitively slides on the image bearing member surface at high speed. Then, a temperature of the blade itself is increased, so that hardness of the blade is decreased. As a result, a frictional force between the image bearing member surface and the blade is increased. Thus, there can arise a problem of an increase in driving torque for driving the image bearing member and turning-up of the blade. Further, in recent years, a spherical developer is used in order to improve the image quality. In this case, in order to remove the developer from the image bearing member surface, there is a need to increase a contact pressure of the blade to the image bearing member, thus constituting one of factors which accelerate the above-described problem.

SUMMARY OF THE INVENTION

The present invention has been accomplished in order to solve the above-described problem of the prior art. A principal object of the present invention is to provide a cleaning device, a process cartridge and an image forming apparatus which are capable of suppressing an increase in driving torque and turning-up of a blade when an image bearing member is driven.

According to an aspect of the present invention, there is provided a cleaning device for use with an image forming apparatus, comprising: a frame including a fixing portion; and a cleaning member, fixed at the fixing portion, for removing a developer from an image bearing member, wherein the cleaning member includes: a blade portion contacted to the image bearing member with respect to a counter direction to a movement direction of the image bearing member; and a flexible supporting member for supporting the blade portion, the supporting member including one end portion where the blade portion is provided, another end portion including a portion-to-be-fixed for being fixed at the fixing portion, and a bent portion between the one end portion and the another end portion in a side remote from a surface of the image bearing member toward an outside with respect to a line connecting the portion-to-be-fixed and a contact portion where the blade portion is contacted to the image bearing member, wherein when a distance between the portion-to-be-fixed and the image bearing member in a longitudinal central side of the portion-to-be-fixed is D1, and a distance between the portion-to-be-fixed and the image bearing member in each of longitudinal end sides of the portion-to-be-fixed is D2, the distances D1 and D2 satisfy: $D1 \leq D2$.

According to another aspect of the present invention, there is provided a process cartridge detachably mountable to a main assembly of an image forming apparatus, comprising: (i) an image bearing member; (ii) a frame including a fixing portion; and (iii) a cleaning member, fixed at the fixing portion, for removing a developer from the image bearing member, wherein the cleaning member includes: a blade portion contacted to the image bearing member with respect to a counter direction to a movement direction of the image bearing member; and a flexible supporting member for supporting the blade portion, the supporting member including one end portion where the blade portion is provided, another end portion including a portion-to-be-fixed for being fixed at the fixing portion, and a bent portion between the one end portion and the another end portion in a side remote from a surface of the image bearing member toward an outside with respect to a line connecting the portion-to-be-fixed and a contact portion where the blade portion is contacted to the image bearing member, wherein when a distance between the portion-to-be-fixed and the image bearing member in a longitudinal central side of the portion-to-be-fixed is D1, and a distance between the portion-to-be-fixed and the image bearing member in each of longitudinal end sides of the portion-to-be-fixed is D2, the distances D1 and D2 satisfy: $D1 \leq D2$.

According to a further aspect of the present invention, there is provided an image forming apparatus for forming an image on a recording material, comprising: (i) a image bearing member; (ii) a frame including a fixing portion; (iii) a cleaning member, fixed at the fixing portion, for removing a developer from the image bearing member, wherein the cleaning member includes: a blade portion contacted to the image bearing member with respect to a counter direction to a movement direction of the image bearing member; and a flexible supporting member for supporting the blade portion, the supporting member including one end portion where the blade portion is provided, another end portion including a portion-to-be-fixed for being fixed at the fixing portion, and a bent portion between the one end portion and the another end portion in a side remote from a surface of the image bearing member toward an outside with respect to a line connecting the portion-to-be-fixed and a contact portion where the blade portion is contacted to the image bearing member, wherein when a distance between the portion-to-be-fixed and the image bearing member in a longitudinal central side of the portion-to-be-fixed is D1, and a distance between the portion-to-be-fixed and the image bearing member in each of longitudinal end sides of the portion-to-be-fixed is D2, the distances D1 and D2 satisfy: $D1 \leq D2$; and (iv) conveying means for conveying the recording material.

These and other objects, features and advantages of the present invention will become more apparent upon a consideration of the following description of the preferred embodiments of the present invention taken in conjunction with the accompanying drawings.

Figure 5:
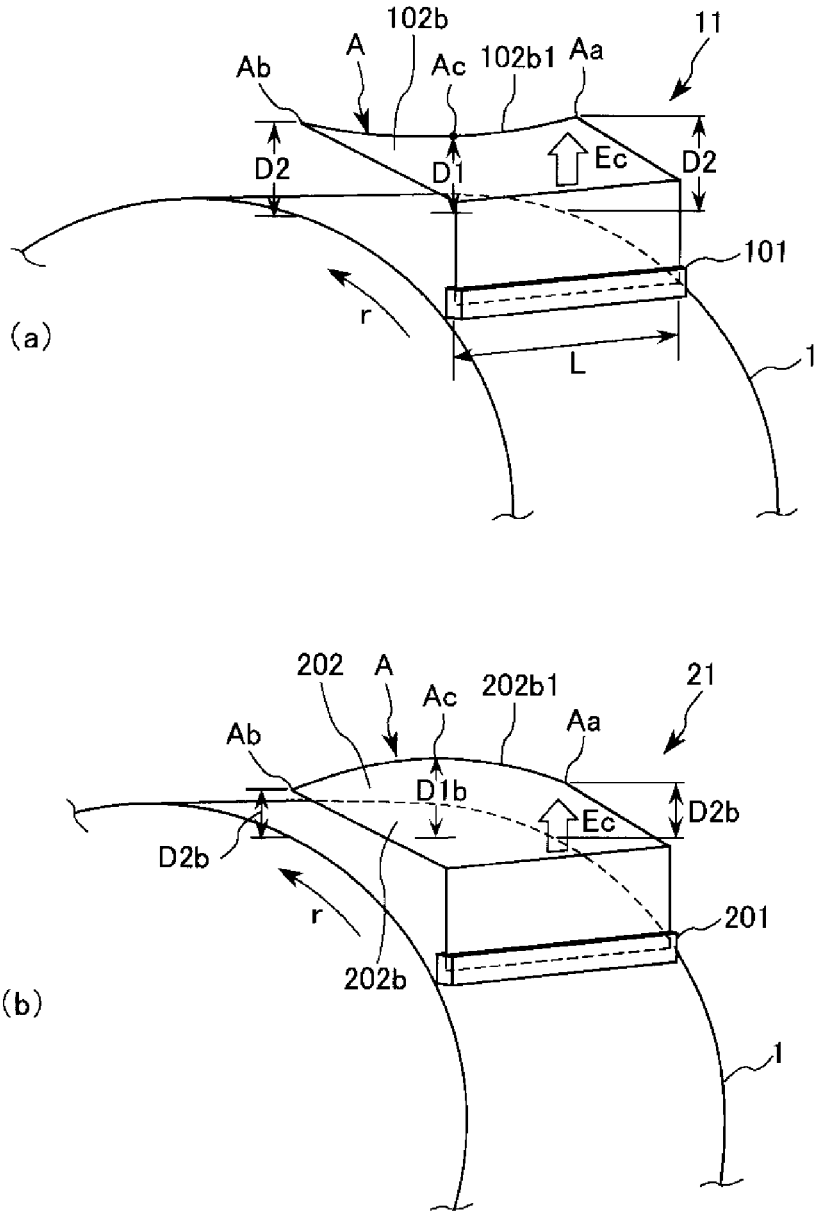

Part (a) of FIG. 5 is a schematic view showing shape of the cleaning member in Embodiment, and (b) of FIG. 5 is a schematic view showing a shape of a cleaning member in Comparison Example.

Figure 6:
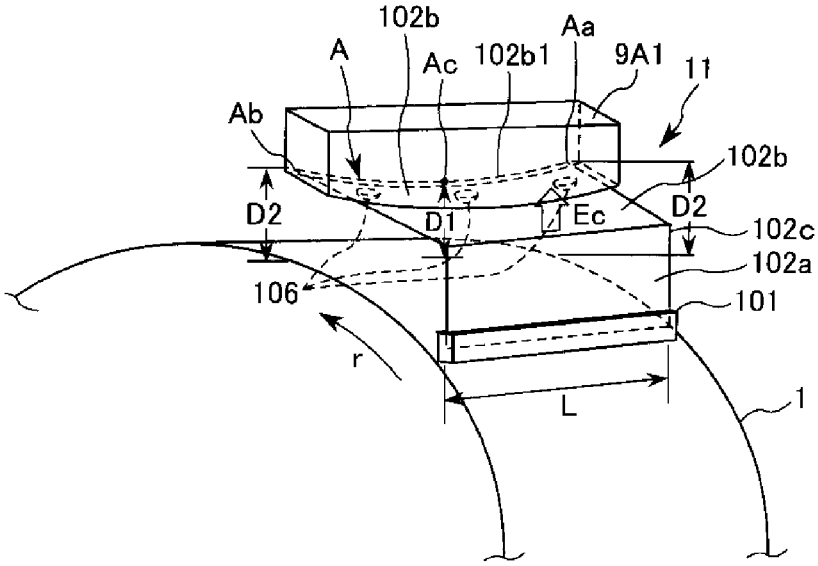

FIG. 6 is a schematic view showing a state when the cleaning member is mounted to a fixing portion.

Figure 7:
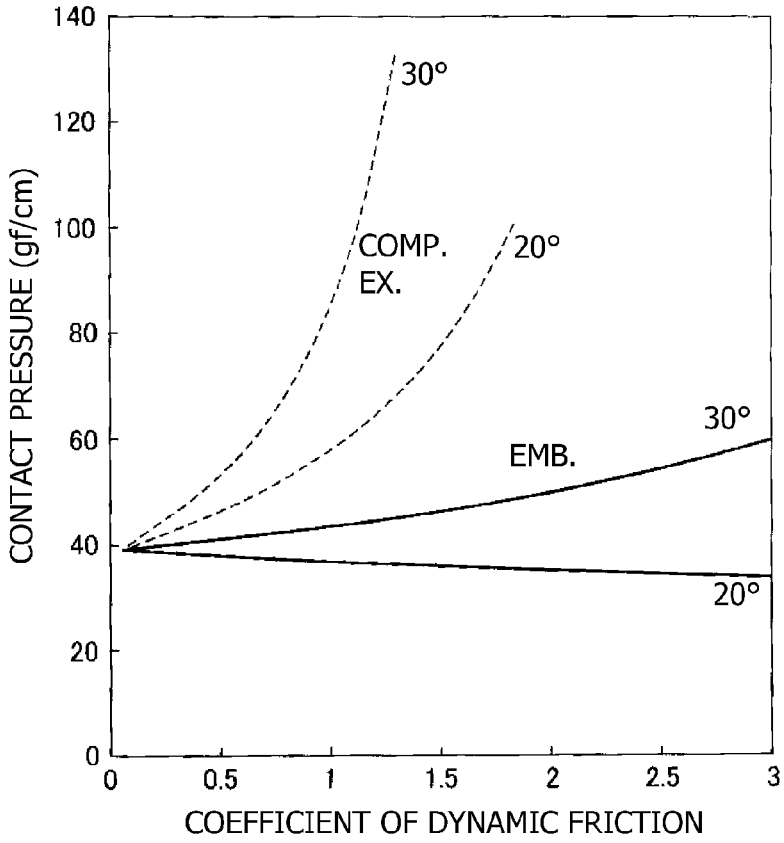

FIG. 7 is a graph showing a result of simulation calculation of a relationship between a coefficient of dynamic friction and a contact pressure resulting from a difference in set angle in Embodiment and Comparison Example.

Figure 8:
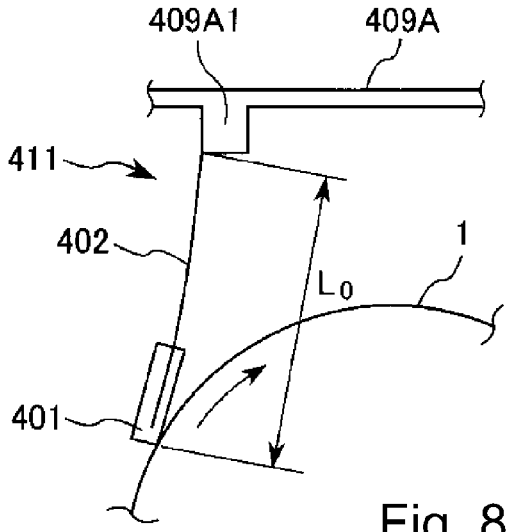

FIG. 8 is a schematic view of the cleaning member in Comparison Example.

DESCRIPTION OF THE PREFERRED EMBODIMENTS

A cleaning device, a process cartridge and an image forming apparatus in an embodiment of the present invention will be described specifically with reference to the drawings.

Embodiment

Image Forming Apparatus

First, a general structure and operation of the image forming apparatus will be described with reference to FIG. 1.

Figure 1:
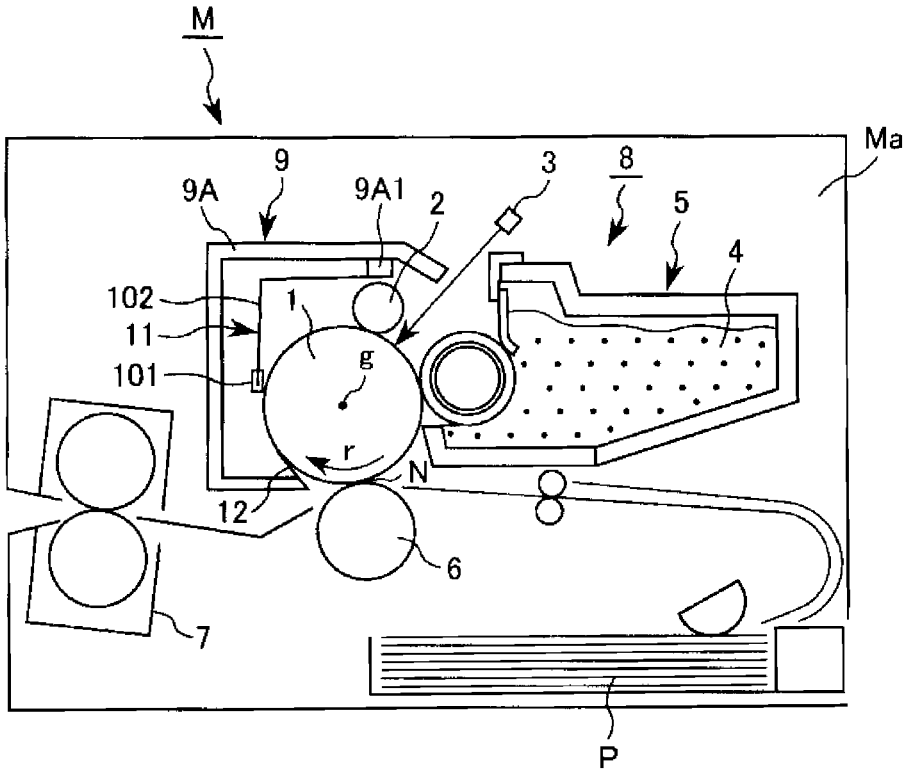
FIG. 1 is a schematic structural view showing an embodiment of an image forming apparatus.

The image forming apparatus M, according to the present invention, shown in FIG. 1 is a monochromatic laser beam printer of an electrophotographic type, and FIG. 1 is a schematic longitudinal sectional view of the image forming apparatus.

In this embodiment, at a substantially central portion of a main assembly Ma of the image forming apparatus M, a drum-type electrophotographic photosensitive member (photosensitive drum) 1 as an image bearing member (member-to-be-charged) is provided. The photosensitive drum 1 is prepared by forming an OPC (organic photoconductor (optical semiconductor)) photosensitive layer on an outer peripheral surface of an electroconductive drum support of aluminum or the like. The photosensitive drum 1 is rotationally driven about an axis (shaft) g in an arrow r direction at a predetermined process speed (peripheral speed) of 200 mm/sec.

The surface (peripheral surface) of the photosensitive drum 1 is electrically charged uniformly to a predetermined polarity and a predetermined potential by a charging roller 2 as a charging means. The surface of the photosensitive drum 1 after the charging is subjected to scanning exposure to a laser beam outputted from a laser beam scanner 3 as an exposure means, so that an electrostatic latent image is formed. This laser beam is modulated correspondingly to a time-series electric digital pixel signal of objective image information, so that the electrostatic latent image corresponding to the objective image information is formed. On this electrostatic latent image, a developer (toner) 4 conveyed by a developing device 5 as a developing means is deposited, so that the latent image is developed as a toner image.

On the other hand, a recording material P as a recording medium is fed by a sheet feeding roller as a feeding means and is sent to a transfer nip N between the photosensitive drum 1 and a transfer roller (transfer means) 6 so as to be synchronized with the toner image formed on the photosensitive drum 1. At the transfer nip N, the toner image is transferred onto the surface of the recording material P. To the transfer roller 6, a transfer bias for transfer is applied from a transfer bias applying power (voltage) source during the transfer.

The recording material P subjected to the toner image transfer is separated from the surface of the photosensitive drum 1 and then is conveyed to a fixing device 7, where the toner image is heated and pressed to be fixed on the surface of the recording material P.

On the other hand, the photosensitive drum 1 after the toner image transfer is subjected to removal of a residual toner, remaining on the surface thereof without being transferred onto the recording material P, by a cleaning member 11 of a cleaning device disposed outside the outer peripheral surface of the photosensitive drum 1, and then is subjected to subsequent image formation.

In this embodiment, four process devices consisting of the photosensitive drum 1, the charging roller 2, the developing device 5 and the cleaning device 9 are integrally assembled with a cartridge frame (not shown) to constitute a process cartridge 8 which is replaceable and is detachably mountable to the apparatus main assembly Ma.

The cleaning member 11 is contacted to the photosensitive drum 1 counter directionally to the movement direction r of the photosensitive drum 1 as shown in FIG. 1. Further, as shown in FIG. 1, the cleaning member 11 enters and contacts the surface of the photosensitive drum 1 and scrapes off the residual toner by an urging force generated by repulsion of the photosensitive drum 1.

Figure 2:
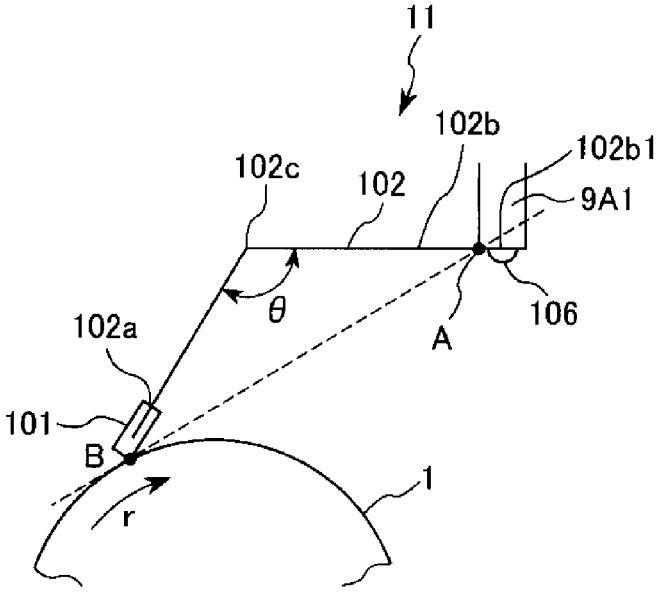
FIG. 2 is a schematic view showing a structure of a cleaning member.

The cleaning device 9 will be described. FIG. 2 shows the cleaning device 9 in this embodiment.

In this embodiment, as shown in FIG. 2, the cleaning member 11 is prepared by mounting the blade portion 101 of a rubber member as an elastic member on a flexible supporting member 102 constituted by a leaf spring at an end portion 102*a*. The supporting member 102 includes the end portion 102*a* where the blade portion is mounted, and includes another end portion 102*b* opposite from the end portion 102*a*. Further, the another end portion 102*b* includes a portion-to-be-fixed 102*b*1 to be fixed on a fixing portion 9A1 of the cleaning container 9A with a screw 106. Further, when the cleaning member 11 is mounted to the cleaning container 9A, the end portion 102*a* is located in an upstream side with respect to a rotational direction of the photosensitive drum 1, and the another end portion 102*b* is located in a downstream side with respect to the rotational direction 1. Further, the supporting member 102 includes a bent portion 102*c* between the end portion 102*a* and the another end portion 102*b* in a side remote from the surface of the photosensitive drum 1 toward an outside with respect to a line (segment) AB connecting A as the portion-to-be-fixed 102*b*1 and a contact portion B where the blade portion 101 is contacted to the photosensitive drum 1.

Figure 3:
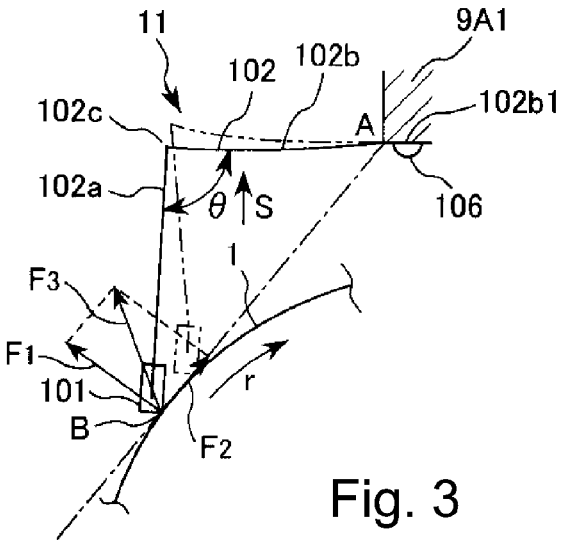
FIG. 3 is a schematic view showing a deformation state of the cleaning member.

By employing such a constitution, as shown in FIG. 3, when the photosensitive drum 1 is rotated, the blade portion 101 receives a force of resultant force F3 which is resultant force between resistance F1 by the contact pressure of the supporting member 102 and frictional force F2 between the surface of the photosensitive drum 1 and the blade portion 101. With respect to this resultant force F3, the end portion

102*a* has a small angle formed between itself and the resultant force F3 and therefore a degree of freedom of deformation is very small, so that the end portion 102*a* is not readily deformed (i.e., thrusts). On the other hand, with respect to a direction of the resultant force F3, the another end portion 102*b* has a large angle formed between itself and the resultant force F3 and therefore the degree of freedom of deformation is high. Therefore, as indicated by a chain line in FIG. 3, the another end portion 102*b* is deformable. Further, the another end portion 102*b* can be deformed with respect to an arrow S direction in FIG. 3, so that the blade portion 101 supported by the supporting member 102 is prevented from entering the photosensitive drum 1. As a result, the increase in reaction F1 is suppressed. For this reason, the increase in driving torque for driving the photosensitive drum 1 and the turning-up of the blade portion 101 can be suppressed. Detailed data will be described later.

Figure 4:
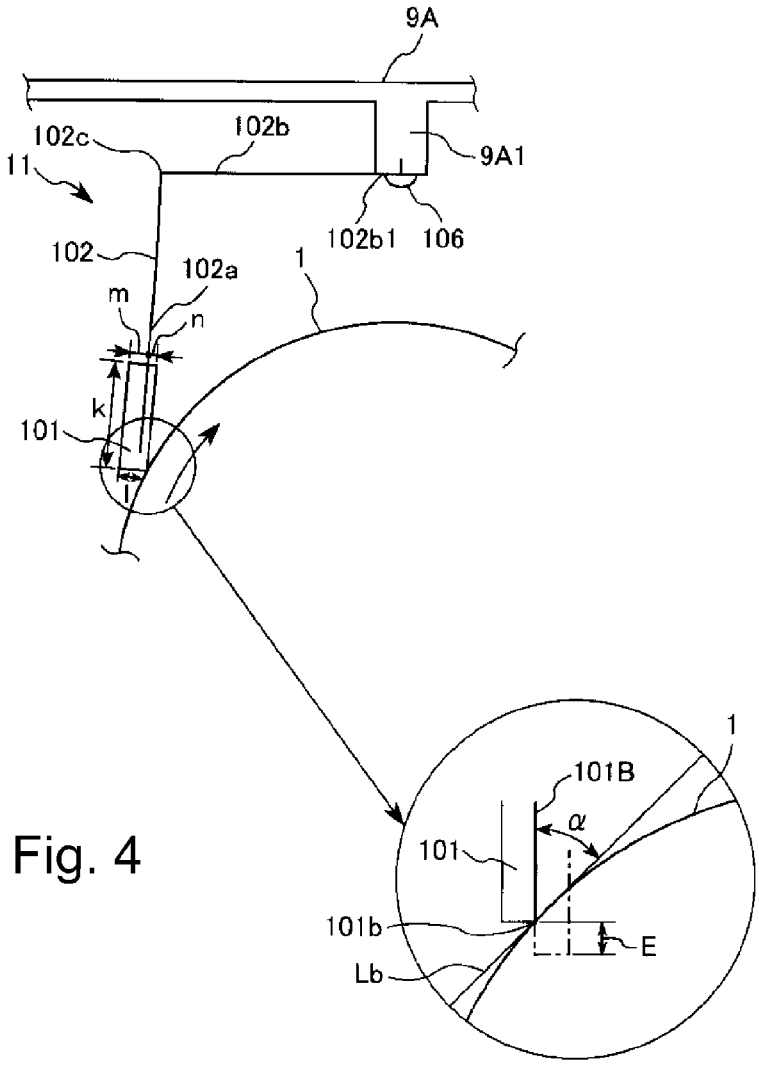
FIG. 4 is a schematic view for illustrating a specific dimensional relation of a cleaning blade mounted on a supporting member.

As the supporting member 102, a 0.2 mm-thick plate-like spring member of SUS304 (Young's modulus: 167000 MPa) was used. The plate-like spring member was subjected to bending of about 90 degrees uniformly with respect to the direction of the axis g of the photosensitive drum 1. In this case, a length of the another end portion 102*b* of the supporting member 102 was 12 mm, and a distance from the end portion 102*a* of the supporting member 102 to an end of the blade portion 101 was 12 mm. As the plate-like spring member, it is possible to use, e.g., a phosphor bronze plate or another member having a spring characteristic. Further, in place of the plate-like spring member, a resin member having elasticity can be used. Further, the blade portion 101 was formed with urethane rubber which is an elastic member, and the urethane rubber member having JIS-A hardness of 70 degrees was used. A shape of the blade portion is as shown in FIG. 4, and in order to reduce a degree of the influence of deformation of the end, the blade portion 101 had a cross section of 3.0 mm in length k, 2.0 mm in width l, 1.0 mm in widthwise length from the supporting member, and 1.0 mm in remaining widthwise length from the supporting member and was subjected to evaluation. As a bonding method between the supporting member 102 and the blade portion 101, other than molding, it is also possible to use a method using a double-sided tape or a hot-melt adhesive.

In a state in which the blade portion 101 does not contact the photosensitive drum 1, the blade portion 101 is in a state indicated by a chain line in FIG. 4. Then, when the blade portion 101 is contacted to the photosensitive drum 1, the state is changed to a state indicated by a solid line in FIG. 4. In this state, a penetration depth (entering amount) of the blade portion 101 is E, and an edge portion 101*b* is contacted to the photosensitive drum 1 at a set angle $\alpha$ of 30 degrees. Here, contact pressure was about 40 gf per cm with respect to the rotational axis direction of the photosensitive drum 1. For comparison, when checking was made at the set angle $\alpha$ of 20 degrees, the contact pressure was about 35 gf per cm with respect to the rotational axis direction of the photosensitive drum 1. At this time, a friction coefficient $\mu$ between the blade portion 101 and the photosensitive drum 1 was 1.0.

(Portion-to-be-Fixed)

The portion-to-be-fixed 102*b*1 of the supporting member 102 will be described with reference to FIG. 5.

In the case where the supporting member 102 is fixed, when distortion or bending (flexure) is generated at the portion-to-be-fixed 102*b*1 of the supporting member 102, geometrical moment of inertia at the another end portion 102*b* of the supporting member 102 is increased and thus strength is increased, so that there was a possibility that a degree of deformation freedom at the another end portion 102*b* was remarkably decreased.

For example, as Comparison Example, a cleaning member 21 is shown in (b) of FIG. 5. In the case where the distortion or the bending is generated at a portion-to-be-fixed 202*b*1, provided as a part of a supporting member 202, to be fixed to a cleaning container and thus the portion-to-be-fixed 202*b*1 has an arcuate shape, the degree of deformation freedom of the supporting member 202 is decreased. That is, in the case where the portion-to-be-engaged 202*b*1 of the supporting member 202 has the arcuate shape which is convex upward as shown in (b) of FIG. 5, strength against stress with respect to an arrow Ec direction shown in (b) of FIG. 5 is increased. That is, with respect to a direction perpendicular to the axis g (FIG. 1) of the photosensitive drum 1, distances D1*b* and D2*b* from the photosensitive drum 1 satisfy: D1*b*>D2*b*. Here, Db1 is a distance between the surface of the photosensitive drum 1 and the portion-to-be-fixed 202*b*1 in a longitudinal central side of the portion-to-be-fixed 202*b*1, and D2*b* is a distance between the surface of the photosensitive drum 1 and the portion-to-be-fixed 202*b*1 in each of longitudinal end sides of the portion-to-be-fixed 202*b*1. Further, in the case of this shape, even when a degree of friction between the photosensitive drum 1 and the blade portion 201 is increased and thus the cleaning member 21 pressed against the photosensitive drum 1, the another end portion 202*b* of the supporting member 202 cannot be deformed sufficiently in a direction (Ec direction) in which the another end portion 202*b* is moved away from the photosensitive drum 1. For that reason, a contact pressure of a rubber portion 201 is increased.

In order to prevent the above-described state, the portion-to-be-fixed 102*b*1 of the supporting member 102 is required to be flat. Alternatively, as shown in (a) of FIG. 5, with respect to the direction perpendicular to the axis g (FIG. 1) of the photosensitive drum 1, distances D1 and D2 between the surface of the photosensitive drum 1 and the portion-to-be-fixed 102*b*1 are required to satisfy: D1≤D2. That is, there is a need to employ a constitution in which the distance between the surface of the photosensitive drum 1 and the portion-to-be-fixed 102*b*1 in a longitudinal central side of the portion-to-be-fixed 102*b*1 is shorter than that in each of longitudinal end sides of the portion-to-be-fixed 102*b*1. In the case of this shape, even when the degree of friction between the photosensitive drum 1 and the blade portion 101 is increased and thus the cleaning member 11 is pressed against the photosensitive drum 1, the another end portion 102*b* of the supporting member 102 can be sufficiently deformed in the direction (Ec direction) in which the another end portion 102*b* is moved away from the photosensitive drum 1.

In FIG. 6, a mounting constitution of the portion-to-be-fixed 102*b*1 to the fixing portion 9A1 for realizing a shape of the portion-to-be-fixed 102*b*1 as shown in (a) of FIG. 5 was shown. A shape of the fixing portion 9A1 for fixing the supporting member 102 is such that the fixing portion 9A1 comes nearer to the photosensitive drum 1 in a longitudinal central side Ac than in each of longitudinal end sides Aa and Ab with respect to the direction perpendicular to the axis g (FIG. 1) of the photosensitive drum 1. When the supporting member 102 is fixed to the fixing portion 9A1, the shape of the portion-to-be-fixed 102*b*1 is, as shown in (a) of FIG. 5, such that the supporting member 102 is located at a position closer to the photosensitive drum 1 in the longitudinal central side Ac than in each of the longitudinal end sides Aa and Ab.

As a means for fixing the supporting member 102 to the fixing portion 9A1, as shown in FIG. 6, the screws 106 are used for the fixing. The screws 106 for the fixing were used at three positions in total in the longitudinal central side Ac and in each of the longitudinal end sides Aa and Ab. By fixing the supporting member 102 in this way, the supporting member 102 is fixed so that it becomes nearer to the photosensitive drum 1 in the longitudinal central side Ac than in each of the longitudinal end sides Aa and Ab.

(Change in Contact Pressure)

Next, a change in contact pressure of each of the cleaning member in this embodiment and the cleaning member having a simple linear structure in Comparison Example will be described.

With reference to FIG. 4, a set angle α will be described. The blade portion 101 is contacted to the photosensitive drum 1 at an edge portion 101*b* of the photosensitive drum 1. The set angle α is an angle formed between a photosensitive drum-side surface 101B of the blade portion 101 and a tangential line Lb at a point of contact between the edge portion 101*b* of the blade portion 101 and the circumference of a circle of the photosensitive drum 1 during the contact. The blade portion 101 is caused to enter the photosensitive drum 1 with the penetration depth E. As a result, the contact pressure of the cleaning blade 101 was about 40 gf/cm with respect to the rotational axis direction of the photosensitive drum 1. For comparison, when checking was made at a set angle α of 20 degrees, the contact pressure was about 35 gf/cm with respect to the rotational axis direction of the photosensitive drum 1.

In order to show a performance of the cleaning member 11 in this embodiment, comparison was made between the cleaning member 11 in this embodiment and a cleaning member 411, shown in FIG. 8, having no bent portion as Comparison Example 1.

In Comparison Example 1, as a flexible member as a supporting member 402 of the cleaning member 411, the 0.2 mm-thick SUS plate which is the same as that used in this embodiment was used. A length L0 from a fixing portion holding member 409A1, between a cleaning container 409A and the supporting member 402, to an end of a blade portion 401 was 21.5 mm. Further, as the (end) blade portion 401, the urethane rubber member having the JIS-A hardness of 70 degrees was used, and its dimension and shape are also the same as those of the blade portion 101 in this embodiment. Similarly as in this embodiment, when the cleaning member 411 was caused to enter the photosensitive drum 1 with the set angle α of 30 degrees and the penetration depth E of 1 mm, the contact pressure of the cleaning member 411 to the photosensitive drum 1 was about 40 gf/cm with respect to the rotational axis direction of the photosensitive drum 1.

As confirmation of an effect, the cleaning members 11 and 411 were subjected to deformation calculation, so that the contact pressure of each cleaning member was estimated. As a calculating method of the deformation calculation, friction between the photosensitive drum 1 and each of the blade portions 101 and 401 was assumed and a relationship between a deformation shape and an applied force when the end portion of the blade portion entered the photosensitive drum 1 with respect to the rotation downstream direction was calculated. Further, from the obtained forces, a component perpendicular to the surface (peripheral surface) of the photosensitive drum 1 was taken as the contact pressure, and a component parallel to the surface of the photosensitive drum 1 was taken as a frictional force. Further, a ratio between the contact pressure and the frictional force was obtained as the dynamic friction coefficient.

As the deformation calculation in this case, in consideration of neutral axes of the blade supporting member and the blade, a simple two-dimensional cantilever beam was used as a model and was subjected to the calculation.

(Assumption of Bernoulli-Euler)

Incidentally, as parameters for the calculation, a flexural rigidity $D=E/(1-\nu)$ of the SUS plate of 150 MPa and a longitudinal modulus E of the urethane rubber member of 6 MPa were used.

FIG. 7 shows the results. In FIG. 7, the abscissa represents a dynamic friction coefficient μ and the ordinate represents the contact pressure (gf/cm). Thus, when compared with the cleaning member 111 having a linear structure as in Comparison Example 1 ("COMP. EX."), with respect to the cleaning member 11 in this embodiment ("EMB."), it was cleared that a change in contact pressure relative to an increase in dynamic friction coefficient was small and thus the cleaning member 11 was stable. That is, as described above, even when the dynamic friction coefficient between the photosensitive drum 1 and the blade portion 101 is changed, it is possible to achieve an effect of suppressing an increase in driving torque for driving the photosensitive drum 1 and suppressing turning-up of the blade portion.

In this embodiment, the monochromatic image forming apparatus is described above, but a multi-color image forming apparatus may also be used if a similar cleaning device is used in the image forming apparatus. Further, the image forming apparatus using no intermediary transfer member is described but an image forming apparatus of an intermediary transfer type may also be used.

As described above, according to the present invention, the increase in torque and the turning-up of the blade portion when the image bearing member is driven can be suppressed, so that the contact pressure of the cleaning member to the image bearing member can be stabilized.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 038054/2012 filed Feb. 23, 2012, which is hereby incorporated by reference.

What is claimed is:

1. A cleaning device for use with an image forming apparatus, comprising:

a frame including a fixing portion; and a cleaning member, fixed at the fixing portion, for removing a developer from an image bearing member, wherein said cleaning member includes: a blade portion contacted to the image bearing member with respect to a direction counter to a movement direction of the image bearing member; and a flexible supporting member for supporting said blade portion, said supporting member including one end portion where said blade portion is provided, another end portion including a portion-to-be-fixed for being fixed at the fixing portion, and a bent portion between said one end portion and said other end portion in a side remote from a surface of the image bearing member toward an outside with respect to a line connecting the portion-to-be-fixed and a contact portion where said blade portion is contacted to the image bearing member, wherein when a distance between the portion-to-be-fixed and the image bearing member in a longitudinal central side of the portion-to-be-fixed is D1, and a distance between the portion-to-be-fixed and the image bearing member in a longitudinal end side of the portion-to-be-fixed is D2, the distances D1 and D2 satisfy: D1<D2.

2. A cleaning device according to claim 1, wherein said cleaning member is fixed to the fixing portion by a screw in the longitudinal central side of and in the longitudinal end side of the portion-to-be-fixed.

3. A cleaning device according to claim 1, wherein said cleaning member is provided so that the portion-to-be-fixed is disposed downstream of the contact portion with respect to a movement direction of the image bearing member.

4. A cleaning device according to claim 1, wherein said supporting member is a leaf spring.

5. A cleaning device according to claim 1, wherein said supporting member is an elastic resin member.

6. A cleaning device according to claim 1, wherein said blade portion is a polyurethane rubber.

7. A process cartridge detachably mountable to a main assembly of an image forming apparatus, comprising:

(i) an image bearing member;

(ii) a frame including a fixing portion; and (iii) a cleaning member, fixed at the fixing portion, for removing a developer from said image bearing member, wherein said cleaning member includes: a blade portion contacted to said image bearing member with respect to a direction counter to a movement direction of said image bearing member; and a flexible supporting member for supporting said blade portion, said supporting member including one end portion where said blade portion is provided, another end portion including a portion-to-be-fixed for being fixed at the fixing portion, and a bent portion between said one end portion and said other end portion in a side remote from a surface of said image bearing member toward an outside with respect to a line connecting the portion-to-be-fixed and a contact portion where said blade portion is contacted to said image bearing member, wherein when a distance between the portion-to-be-fixed and said image bearing member in a longitudinal central side of the portion-to-be-fixed is D1, and a distance between the portion-to-be-fixed and said image bearing member in a longitudinal end side of the portion-to-be-fixed is D2, the distances D1 and D2 satisfy: D1<D2.

8. A process cartridge according to claim 7, wherein said cleaning member is fixed to the fixing portion by a screw in the longitudinal central side of and in the longitudinal end side of the portion-to-be-fixed.

9. A process cartridge according to claim 7, wherein said cleaning member is provided so that the portion-to-be-fixed is disposed downstream of the contact portion with respect to a movement direction of said image bearing member.

10. A process cartridge according to claim 7, wherein said supporting member is a leaf spring.

11. A process cartridge according to claim 7, wherein said supporting member is an elastic resin member.

12. A process cartridge according to claim 7, wherein said blade portion is a polyurethane rubber.

13. An image forming apparatus for forming an image on a recording material, comprising:

(i) an image bearing member;

(ii) a frame including a fixing portion;

(iii) a cleaning member, fixed at the fixing portion, for removing a developer from said image bearing member, wherein said cleaning member includes: a blade portion contacted to the image bearing member with respect to a direction counter to a movement direction of said image bearing member; and a flexible supporting member for supporting said blade portion, said supporting member including one end portion where said blade portion is provided, another end portion including a portion-to-be-fixed for being fixed at the fixing portion, and a bent portion between said one end portion and said other end portion in a side remote from a surface of said image bearing member toward an outside with respect to a line connecting the portion-to-be-fixed and a contact portion where said blade portion is contacted to said image bearing member, wherein when a distance between the portion-to-be-fixed and said image bearing member in a longitudinal central side of the portion-to-be-fixed is D1, and a distance between the portion-to-be-fixed and said image bearing member in a longitudinal end side of the portion-to-be-fixed is D2, the distances D1 and D2 satisfy: D1<D2; and (iv) conveying means for conveying the recording material.

14. An image forming apparatus according to claim 13, wherein said cleaning member is fixed to the fixing portion by a screw in the longitudinal central side of and in the longitudinal end side of the portion-to-be-fixed.

15. An image forming apparatus according to claim 13, wherein said cleaning member is provided so that the portion-to-be-fixed is disposed downstream of the contact portion with respect to a movement direction of said image bearing member.

16. An image forming apparatus according to claim 13, wherein said supporting member is a leaf spring.

17. An image forming apparatus according to claim 13, wherein said supporting member is an elastic resin member.

18. An image forming apparatus according to claim 13, wherein said blade portion is a polyurethane rubber.

19. A cleaning device according to claim 1, wherein the longitudinal end side of the portion-to-be-fixed is either one of two longitudinal end sides of the portion-to-be-fixed.

20. A process cartridge according to claim 7, wherein the longitudinal end side of the portion-to-be-fixed is either one of two longitudinal end sides of the portion-to-be-fixed.

21. An image forming apparatus according to claim 13, wherein the longitudinal end side of the portion-to-be-fixed is either one of two longitudinal end sides of the portion-to-be-fixed.

22. A cleaning device according to claim 1, wherein said supporting member has a thickness of 0.2 mm.

23. A process cartridge according to claim 7, wherein said supporting member has a thickness of 0.2 mm.

24. An image forming apparatus according to claim 13, wherein said supporting member has a thickness of 0.2 mm.

25. A cleaning device according to claim 1, wherein the bent portion is positioned upstream of said one end portion and downstream of said other end portion with respect to a rotational direction of said image bearing member.

26. A cleaning device according to claim 7, wherein the bent portion is positioned upstream of said one end portion and downstream of said other end portion with respect to a rotational direction of said image bearing member.

27. A cleaning device according to claim 13, wherein the bent portion is positioned upstream of said one end portion and downstream of said other end portion with respect to a rotational direction of said image bearing member.

* * * * *